United States Patent [19]

Mills

[11] Patent Number: 4,848,180

[45] Date of Patent: Jul. 18, 1989

[54] LOW-FRICTION, BOAT-TYPE ROCKER ARM

[75] Inventor: Jesse V. Mills, Toledo, Ohio

[73] Assignee: Henley Manufacturing Corporation, Hampton, N.H.

[21] Appl. No.: 241,062

[22] Filed: Sep. 6, 1988

[51] Int. Cl.[4] ..... F01L 1/18

[52] U.S. Cl. ..... 74/519; 74/559; 29/156.4 R; 123/90.39; 123/30.44; 123/30.36

[58] Field of Search ..... 29/156.4 R, 156.7 B; 123/90.39, 90.44, 90.36, 90.41, 90.42; 74/519, 523, 559

[56] References Cited

U.S. PATENT DOCUMENTS

| | | | |
|---|---|---|---|
| 3,064,635 | 11/1962 | Rohrbacher | 74/559 X |
| 3,466,073 | 9/1963 | Pohle | 123/90.3 G |
| 3,621,823 | 11/1971 | Lombardi | 74/519 X |
| 3,911,879 | 10/1975 | Altmann | 123/90.39 X |
| 4,182,290 | 1/1980 | Pohlei | 74/519 X |
| 4,440,121 | 4/1984 | Clancy et al. | 123/90.39 |
| 4,614,171 | 9/1986 | Malhotra | 123/90.39 X |
| 4,628,874 | 12/1986 | Barlow | 123/90.39 X |
| 4,674,453 | 6/1987 | Dove | 29/156.4 R |
| 4,682,575 | 7/1987 | Simko | 123/90.39 X |
| 4,694,788 | 9/1987 | Craig | 123/30.39 X |
| 4,718,379 | 1/1988 | Clark | 123/90.39 |
| 4,724,803 | 2/1988 | Williams | 123/90.39 |
| 4,727,832 | 3/1988 | Miyamura et al. | 123/90.44 |
| 4,796,483 | 1/1989 | Patel et al. | 74/559 X |

FOREIGN PATENT DOCUMENTS

| | | | |
|---|---|---|---|
| 1208943 | 1/1966 | Fed. Rep. of Germany | 123/90.39 |
| 2082266 | 3/1982 | United Kingdom | 123/90.39 |

*Primary Examiner*—Vinh Luong

*Attorney, Agent, or Firm*—Allen D. Gutchess, Jr.

[57] ABSTRACT

A low-friction, boat-type, cold-formed rocker arm is provided. The rocker arm is of generally U-shaped configuration in transverse cross section throughout most of its length. An intermediate portion of the rocker arm has a concave interior surface extending thereacross with a central opening through which a shank of a pedestal extends. One end portion of the rocker arm has a concave recess facing downwardly to receive the upper end of a push rod. The other end portion of the rocker arm has a rectangular opening in the bottom thereof. An axle extends between side walls of the rocker arm above the rectangular opening and a roller is rotatably mounted on the axle and has a circumferential portion exposed at the rectangular opening. The roller engages an end of a valve stem with rolling, rather than sliding, contact, resulting in lower friction during operation of the rocker arm.

5 Claims, 2 Drawing Sheets

LOW-FRICTION, BOAT-TYPE ROCKER ARM

This invention relates to a cold-formed rocker arm and more particularly to a low-friction, boat-type rocker arm.

The new rocker arm is cold-formed and is designed to operate with lower friction. The rocker arm has an intermediate portion which is supported by a pedestal. One end of the rocker arm has a downwardly-facing recess which receives an end of a push rod. The other end of the rocker arm has an opening with a roller being mounted on an axle extending between side walls of the rocker arm and having a circumferential portion exposed at the opening. The roller contacts an end of a valve stem with a rolling, rather than a sliding, motion. This results in lower friction during operation of the rocker arm and the engine.

It is, therefore, a principal object of the invention to provide a boat-type rocker arm which results in lower friction during operation.

Another object of the invention is to provide a cold-formed, boat-type rocker arm which carries a roller at one end positioned to contact an end of a valve stem with a rolling rather than a sliding motion.

Many other objects and advantages of the invention will be apparent from the following detailed description of a preferred embodiment thereof, reference being made to the accompanying drawings, in which.

Figure 1:
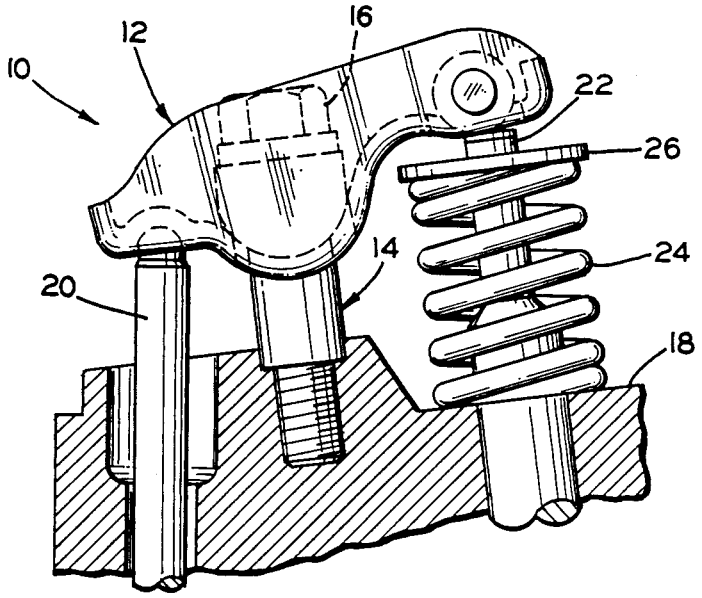
FIG. 1 is a fragmentary, somewhat schematic side view in elevation of a rocker arm assembly in accordance with the invention, mounted on an engine shown in cross section.

Referring to the drawings and particularly to FIG. 1, a rocker arm assembly in accordance with the invention is indicated at 10 and includes an elongate, cold-formed boat-type rocker arm 12 mounted on a supporting pedestal 14. A suitable threaded fastener 16 extends through a bore in the pedestal 14 and mounts the assembly on a cylinder head 18 of an engine block. One end of the rocker arm 12 engages the upper end of a push rod 20 and the other end of the rocker arm engages the upper end of a valve stem 22. The valve stem extends upwardly from a valve (not shown) in the cylinder head through a coiled compression spring 24 located therearound and which is between the cylinder head 18 and a retainer ring 26 mounted on the valve stem 22.

Figure 2:
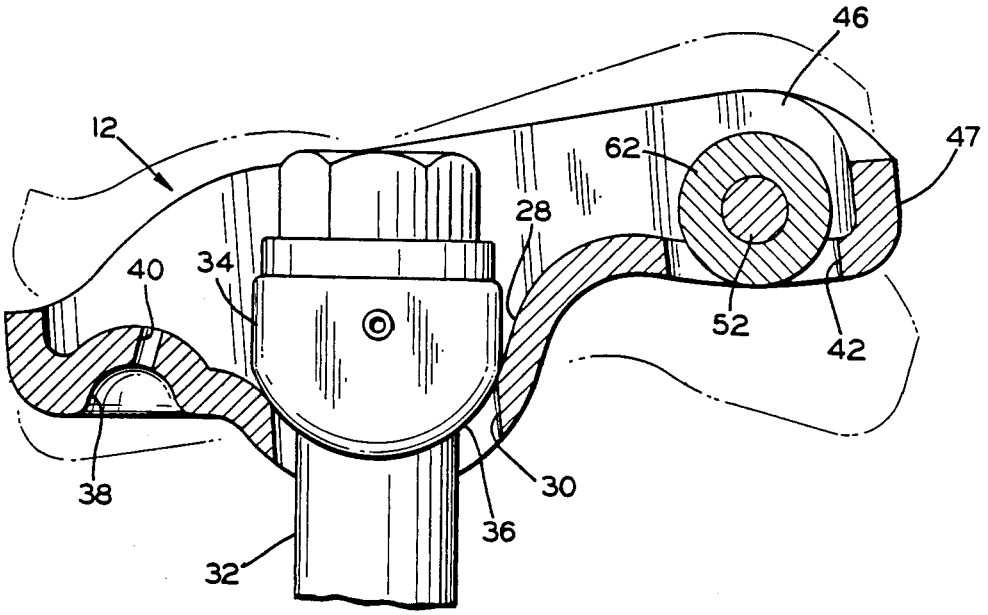
FIG. 2 is an enlarged view in longitudinal cross section taken through the rocker arm assembly of FIG. 1, with extreme positions of the rocker arm shown in dotted lines.
Figure 3:
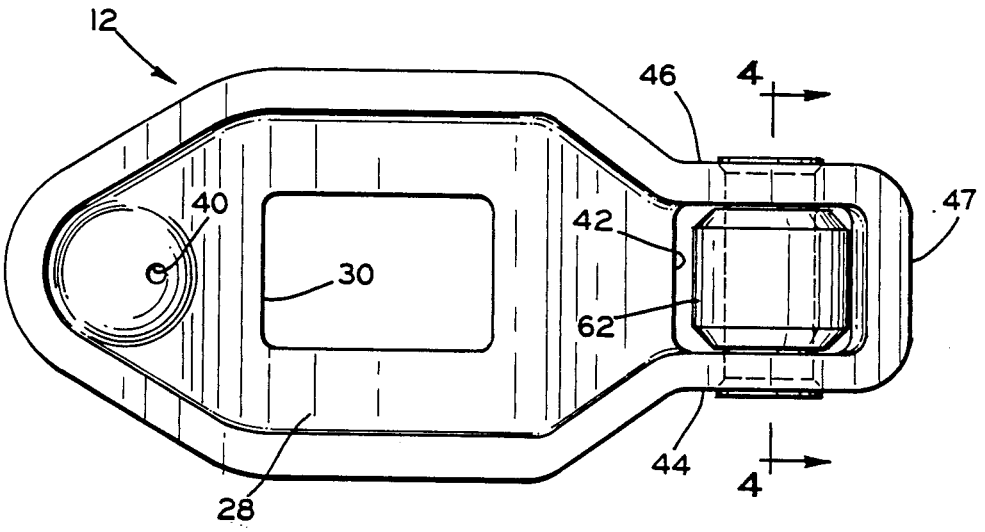
FIG. 3 is a top view of the rocker arm.

Referring to FIGS. 2 and 3, the rocker arm 12 has a an intermediate recessed area or surface 28 which is of generally semi-cylindrical shape. The recess 28 has a central opening 30 through which a shank 32 of the pedestal 14 extends. The pedestal 14 also includes a fulcrum 34 with a lower, downwardly-facing surface 36 of a predetermined radius. The surface 36 engages the recessed surface 28 of the rocker arm and supports the arm for rocking movement.

One end portion of the rocker arm 12 has a concave recess 38 facing downwardly with a lubricating hole 40 communicating with the recess and with the interior of the rocker arm. The recess 38 engages the upper end of the push rod 20 with the push rod causing the rocking motion of the rocker arm 12.

Figure 4:
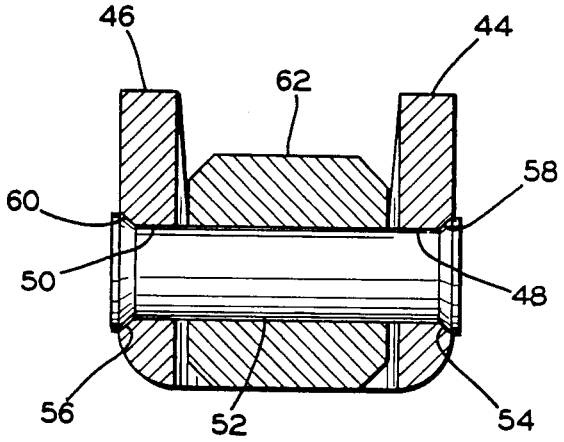
FIG. 4 is a view in transverse cross section taken along the line 4—4 of FIG. 3.

The other end portion of the rocker arm 12 has a rectangular end opening 42 which extends between side walls 44 and 46 of the rocker arm and almost to an end wall 47 thereof. The side walls 44 and 46 have aligned round openings 48 and 50 which receive an axle 52. The axle 52 has flared ends 54 and 56 which are received in flared ends 58 and 60 of the openings 48 and 50 to prevent longitudinal and rotational movement of the axle 52. A roller 62, which extends a substantial portion of the distance between the side walls 44 and 46, is rotatably supported on the axle 52. A portion of the circumference of the roller 62 is exposed at the opening 42 and extends at least partly through the opening 42, as shown in FIGS. 2 and 4. The roller 62 is positioned to engage the end of the valve stem 22, thus establishing rolling motion between the valve stem and the rocker arm 12 rather than sliding motion between the valve stem and the end of the rocker arm, as has heretofore been the case. This rolling motion results in lower friction during the operation of the rocker arm and the engine, thereby improving the efficiency of the engine.

In one form, the lower circumferential extremity of the roller 62 is flush with the lower side edges of the rectangular opening 42 so that the roller can contact the end of the valve stem 22 in the same position as if the lower surface of the rocker arm end were solid instead of having the opening 42 and the roller 62. This enables the rocker arm 12 to be substituted for a conventional one without requiring changes in dimensions or positions of any of the engine components.

Various modifications of the above-described embodiment of the invention will be apparent to those skilled in the art and it is to be understood that such modifications can be made without departing from the scope of the invention, if they are within the spirit and the tenor of the accompanying claims.

I claim:

1. A boat-type rocker arm assembly comprising a pedestal having a fulcrum and a shank, said fulcrum extending outwardly beyond two opposite sides of said shank, said fulcrum having curved lower surfaces of a predetermined radius, an elongate, cold-formed, boat-type rocker arm of generally U-shaped configuration in transverse cross section throughout most of its length and having an intermediate curved interior surface extending there-across between its ends, said interior surface being straight as viewed in transverse cross section, said rocker arm having an opening centrally located in the intermediate surface through which said shank of said pedestal extends, one end portion of said rocker arm having a concave recess adapted to receive the upper end of a push rod, the other end portion of said rocker arm having a rectangular opening therein, side walls of said rocker arm above said rectangular opening having round openings therein, an axle extending through said round openings and mounted in said side walls for prevention of longitudinal movement of said axle, and a roller rotatably mounted on said axle and having a circumferential portion exposed at said rectangular opening whereby said roller engages a valve stem.

2. A rocker arm assembly according to claim 1 characterized by a circumferential portion of said roller being flush with lower side edges of said rectangular opening.

3. A boat-type rocker arm which is cold-formed, said rocker arm being of generally U-shaped configuration in transverse cross section substantially throughout its length and having a curved interior surface with a central opening to receive a shank of a pedestal, one end portion of said rocker arm having means adapted to receive an end of a push rod, the other end portion of said rocker arm having an end opening therein, side walls of said rocker arm above said end opening having round openings therein, an axle extending through said round openings and mounted in said said side walls for prevention of longitudinal movement of said axle, and a roller rotatably mounted on said axle and having a circumferential portion exposed at said end opening whereby said roller engages a valve stem.

4. A rocker arm according to claim 3 characterized by a circumferential portion of said roller being flush with lower side edges of said end opening.

5. A boat-type rocker arm of generally U-shaped configuration in transverse cross section substantially throughout its length and having a central opening to receive a shank of a pedestal, one end portion of said rocker arm having a recess adapted to receive an end of a push rod, the other end portion of said rocker arm having an end opening therein, an axle mounted in side walls of said rocker arm above said end opening, and a roller rotatably mounted on said axle and having a circumferential portion exposed at said end opening and being flush with lower side edges of said end opening whereby said roller engages a valve stem.

* * * * *